United States Patent [19]

Kennedy

[11] 3,988,847

[45] Nov. 2, 1976

[54] COMBINED CYLINDER-RELEASE AND SAFETY LEVER FOR REVOLVERS

[75] Inventor: Ralph C. Kennedy, South Windsor, Conn.

[73] Assignee: The Leisure Group, Inc., Los Angeles, Calif.

[22] Filed: Sept. 8, 1975

[21] Appl. No.: 611,533

[52] U.S. Cl. ..... 42/66; 42/62

[51] Int. Cl.[2] ..... F41C 17/08

[58] Field of Search ..... 42/66, 65, 62

*Primary Examiner*—Charles T. Jordan

*Attorney, Agent, or Firm*—St.Onge Mayers Steward & Reens

[57] ABSTRACT

A combined cylinder-release and safety device for a double-action revolver having a finger lever which is held in its normal, safety-off, position by the cylinder-spindle spring for manipulation in one direction against the pressure of the spring in order to release the cylinder. Provision is made for also moving the finger lever in the other direction beyond its normal position in order to lock the action, so that the gun cannot be fired either in double-action or in single-action.

6 Claims, 9 Drawing Figures

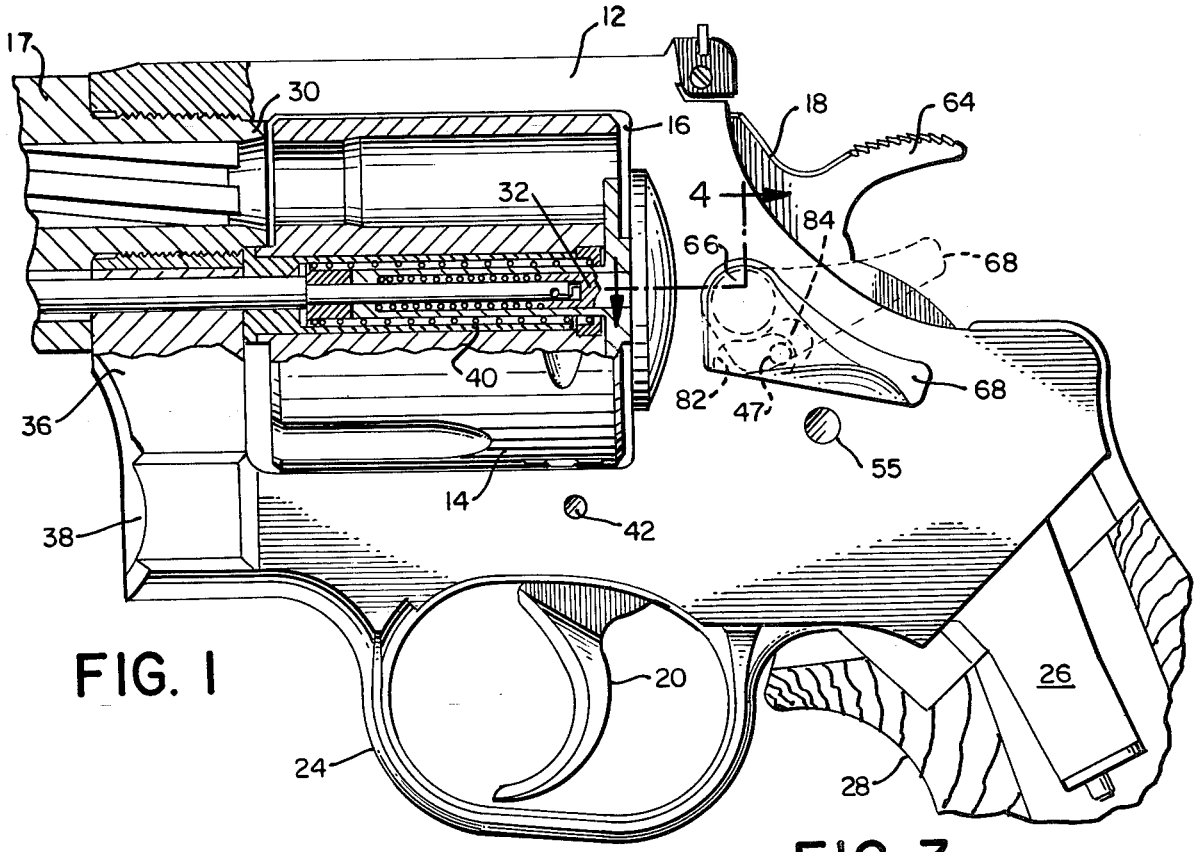
FIG. 1
FIG. 2
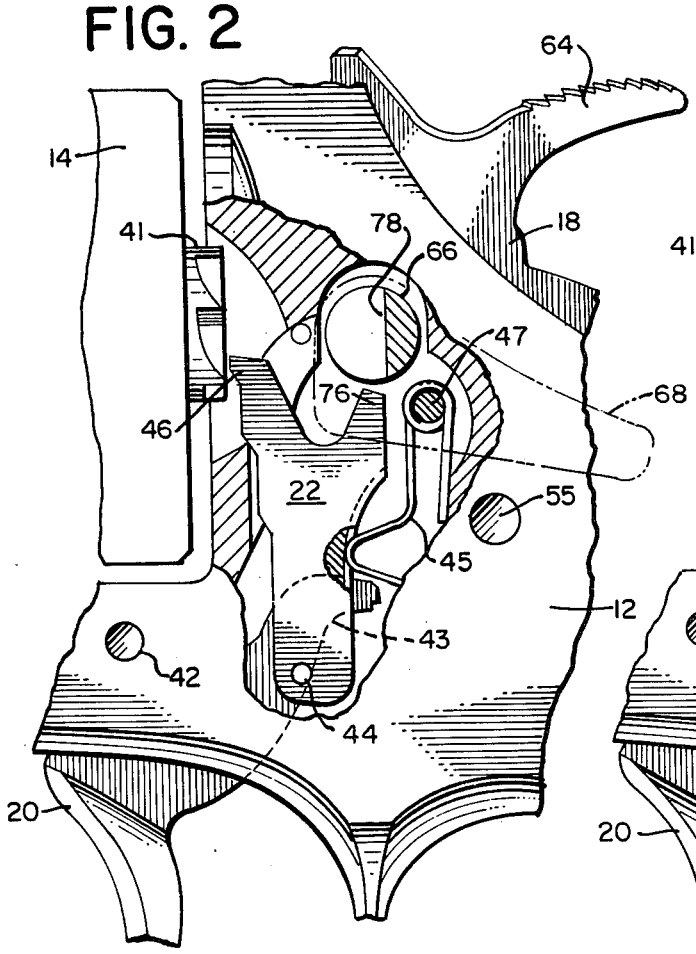
FIG. 3
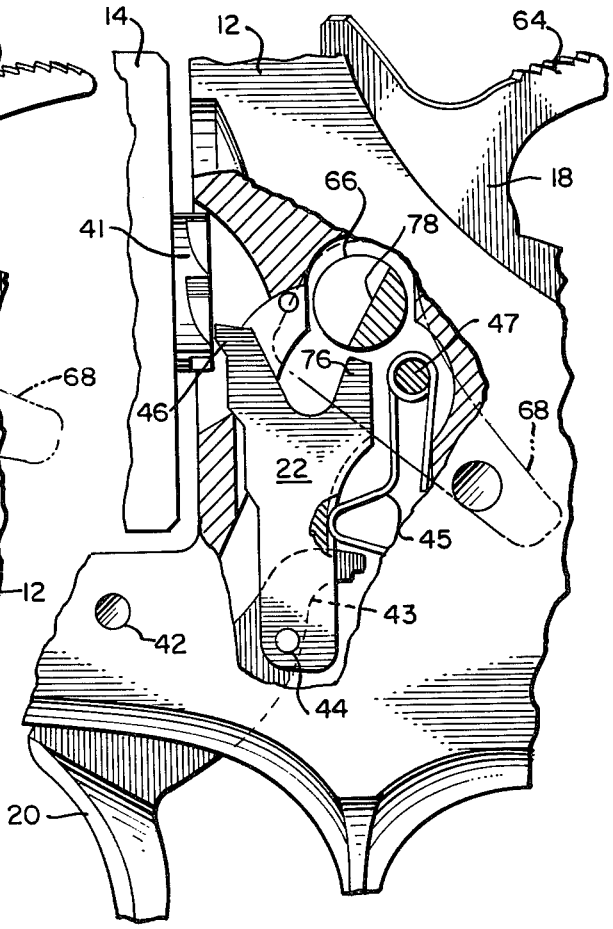

FIG. 7
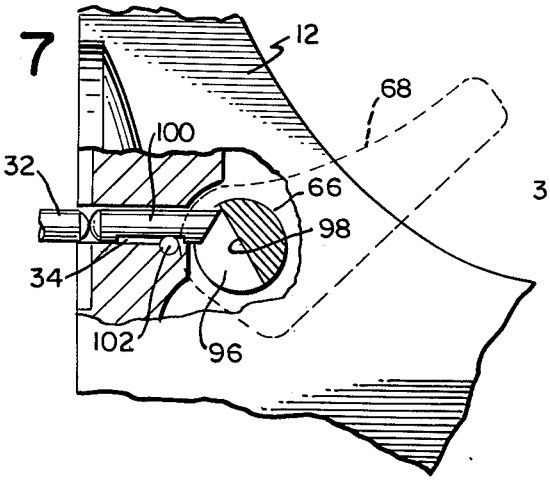
FIG. 6
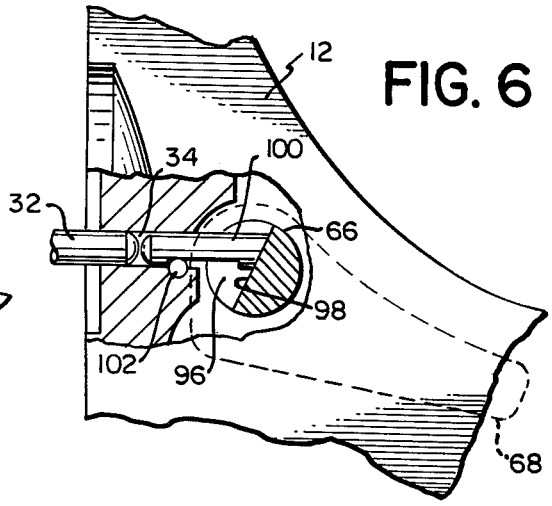
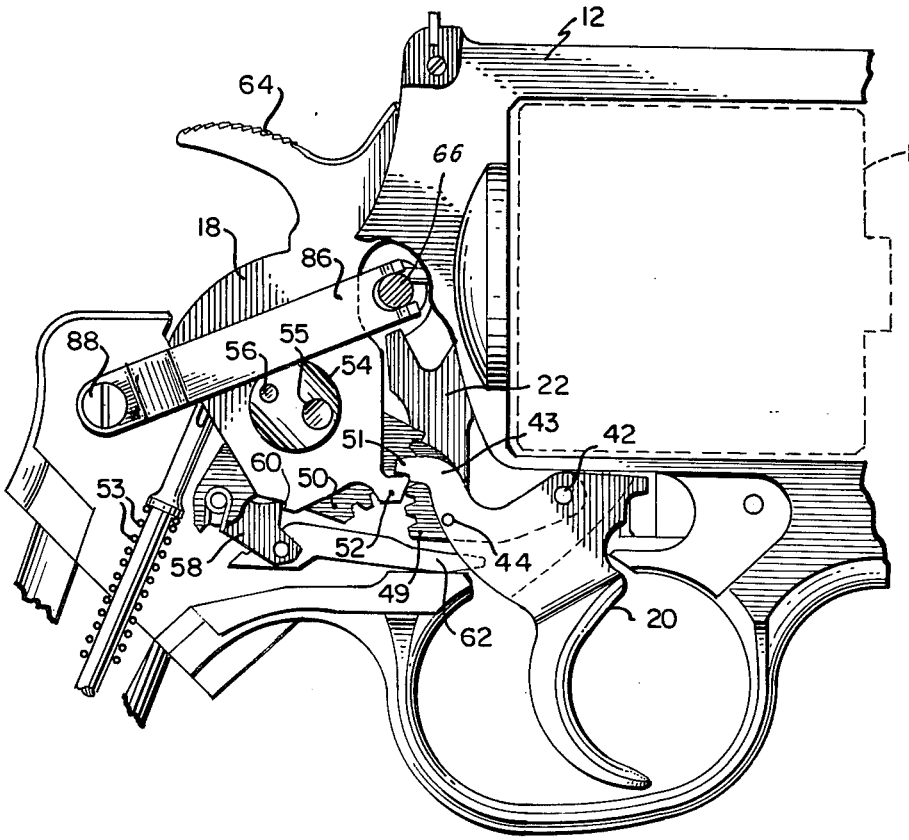
FIG. 8
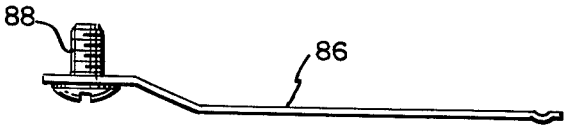
FIG. 9

COMBINED CYLINDER-RELEASE AND SAFETY LEVER FOR REVOLVERS

BACKGROUND OF THE INVENTION

The present invention relates to firearms of the type known as revolvers, and it relates more particularly to a combined cylinder-release and safety device therefor.

Due primarily to their reliability, revolvers are a favorite type of handgun for police work. Furthermore, double-action revolvers are relatively safe to handle because the hammer can be kept in the uncocked position, while still making it possible to fire the gun quickly in double-action by simply pulling the trigger. There are times, however, when it is desirable to make a revolver doubly safe by preventing it from being fired in double-action.

By the same token, it is important that the gun have certain basic features of design including a swing-out cylinder for ease of reloading and cleaning, as well as a convenient system for releasing the cylinder so that it can be swung out. On the other hand, it is equally important to avoid complicating the operation of the gun by cluttering it with levers and gadgets.

Accordingly an object of the present invention is to provide a cylinder-release lever which can be manipulated not only to release the cylinder, but also to positively lock the trigger mechanism, thereby avoiding the necessity of adding a separate safety lever. Another object of the invention is to prevent inadvertent locking of the trigger mechanism due to accidental movement of the combined cylinder-release and safety lever to its safe position.

SUMMARY OF THE INVENTION

The invention resides basically in pivotally mounting a cam shaft behind the cartridge cylinder with its cam positioned to transmit axial motion to the spring-loaded spindle on which the cylinder is rotated, so that when the shaft is pivoted in one direction against the pressure of the spindle, the end of the spindle is driven out of its latching passage in the frame, releasing the cylinder so that it can swing outward to one side of the frame. The spindle in turn applies a constant pressure on the cam shaft to pivot it in the opposite direction against a stop, so that the cam shaft is held in its normal position. A second portion of the cam shaft is so formed that when it is pivoted in said opposite direction beyond the stop, it is moved into the path of an action member for positively preventing firing of the gun. Means are provided for circumventing the stop and for then manually pivoting the shaft beyond the stop in order to lock the trigger mechanism so that the gun can not be operated in double-action.

The aforementioned action member may be any convenient part of the action, such as the cylinder-indexing hand which moves through a predetermined path as the trigger is pulled in double-action.

DETAILED DESCRIPTION OF THE PREFERRED EMBODIMENT

In the drawings,

FIG. 1 is a partial side elevational view of a revolver embodying the invention, portions being shown broken away and in section;

FIG. 2 is an enlarged partial side elevational view with part of the frame broken away in order to expose the cylinder indexing hand, the cam shaft being shown in section on a plane through the portion which cooperates with the cylinder hand;

FIG. 3 is a view similar to FIG. 2, but showing the cam shaft rotated to block the cylinder hand;

FIG. 6 is a view similar to FIG. 2, but showing the cylinder-release cam shaft in section on a plane through the cylinder spindle;

FIG. 7 is a view similar to FIG. 6, but showing the cam shaft pivoted to a position for releasing the cylinder;

FIG. 8 is a partial side elevation view of the opposite side of the revolver from FIG. 1, with the cover-plate removed in order to expose the action; and FIG. 9 is an edge view of a spring member shown in FIG. 8.

Figure 4:
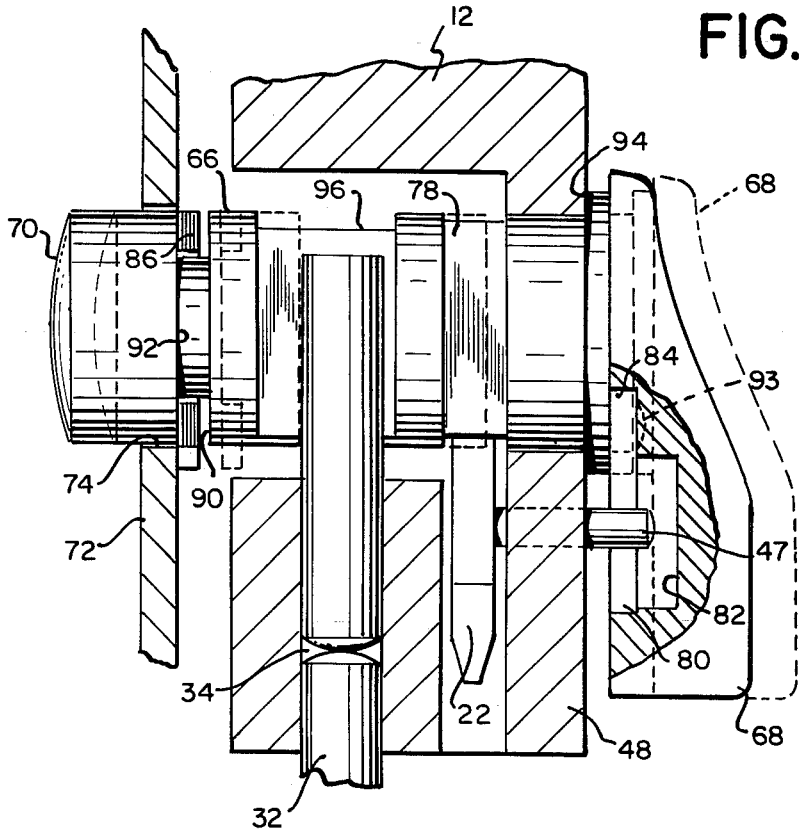
FIG. 4 is an enlarged more-or-less schematic view of the cam shaft and related parts taken in section generally along the line 4—4 of FIG. 1.

The cylinder release and action safety of the present invention is disclosed for convenience sake in connection with the revolver shown and described in U.S. patent applications of Richard L. Baker, Ser. No. 526,719 filed Nov. 25, 1974 and Ser. No. 561,249 filed Mar. 24, 1975. The revolver consists basically of a frame 12, a cartridge cylinder 14 rotatably mounted in a central opening 16 of frame 12, a barrel 17, a hammer 18, a trigger 20, and a cylinder indexing pawl or hand 22 (FIGS. 2 and 3). Frame 12 includes a trigger-guard 24 and a tang-portion 26, on which the grip 28 is fastened. Barrel 17 is rigidly mounted in the front of frame 12 and has a rear extension 30 that projects a short distance into the central opening 16 into close proximity with the front end-wall of cylinder 14.

Cylinder 14 is mounted on a spindle 32, the rear end of which protrudes a short distance from the rear face of cylinder 14 for engagement within a passage 34 (FIGS. 6 and 7) in the center of frame 12. Spindle 32 extends forward from cylinder 14 below the barrel 17 and is journaled in a cylinder crane 36, by which it may be swung out laterally of frame 12 in order to reload the cylinder in the usual manner. The lower end of crane 36 is pivoted to the frame 12 at 38, so that when spindle 32 is moved longitudinally against the pressure of a compression spring 40 its rearmost end is withdrawn from the passage 34 allowing cylinder 14 to swing completely out of the central opening 16 in the frame. A ratchet wheel 41 (FIGS. 2 and 3) is mounted concentrically on cylinder 14 at its rear end for rotation therewith and has a plurality of radially disposed teeth which are engaged by the indexing hand 22 in sequence for rotating cylinder 14 each time the gun is to be fired, in order to index the chambers sequentially into alignment with the barrel 17.

Trigger 20 is pivoted on the frame 12 about a pivot pin 42 for actuation in the usual manner. Cylinder hand 22 is pivotally connected at its lower end to a rearwardly and upwardly projecting portion 43 of trigger 20 by a pivot pin 44 and is resiliently urged forward at its upper end by means of a torsion spring 45 for engagement of its nose 46 with ratchet 41. Each time trigger 20 is retracted, hand 22 indexes cylinder 14 to move the next chamber into line with the barrel. Spring 45 is held by a pin 47, which is mounted in the side wall 48 of frame 12 and extends both inwardly to receive the coiled portion of spring 45 as well as outwardly as shown in FIG. 4 for a purpose to be more fully described hereinafter.

As illustrated in FIG. 8 a gear-segment 49 is rigidly fixed to the trigger by means of pivot pins 42 and 44 for meshing engagement with a gear-plate 50 on hammer 18 for pivoting the hammer into its cocked position. One end of pin 44 projects through the trigger into a hole at the lower end of cylinder hand 22, thereby pivotally connecting the hand 22 to the trigger. A conventionally shaped sear-nose 51 is provided on the rear extension 43 of trigger 20 for cocking engagement with a cocking foot 52 on hammer 18 for cocking the hammer in single-action against the pressure of the main hammer spring 53.

In this instance, hammer 18 is pivoted on a circular eccentric plate 54, which in turn is eccentrically pivoted on a hammer pin 55 mounted at both ends in the frame 12. Gear-plate 50 is rigidly connected by means of a clevis pin 56 to eccentric plate 54 for pivotal movement therewith about hammer pin 55. In order to retract the hammer by means of trigger 20 in double-action, a sear 58 is pivoted to a projection on the lower rear portion of gear-plate 50 in position for locking engagement with a sear-notch 60 on the lower edge of hammer 18. As the trigger is pulled (clockwise as shown in FIG. 8), pivoting gear-plate 50 counterclockwise about hammer pin 55, the sear 58 engages notch 60 in the hammer so that the hammer is pivoted counterclockwise against the pressure of spring 53. Shortly before the trigger reaches its fully retracted position, a finger 62 extending forwardly from sear 58 engages a fixed abutment (not shown), and pivots sear 58 clockwise on gear-plate 50, so that the sear is disengaged from the sear-notch 60, freeing hammer 18 to pivot on eccentric plate 54 under the pressure of the hammer spring.

It will be noted that when the hammer is retracted in single-action by means of its thumb-piece 64, cocking foot 52 engages the sear-nose 51 of the trigger, pivoting it clockwise. This in turn not only causes the gears 49 and 50 to pivot correspondingly, but also raises cylinder hand 22 so that cylinder 14 is indexed each time the hammer is retracted to its cocked position.

Figure 5:
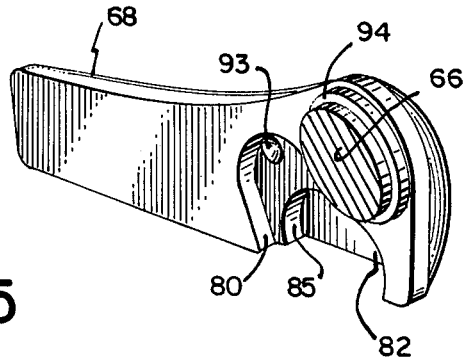
FIG. 5 is a perspective view of the lever portion of the cylinder release and action safety with the cam shaft broken away and in cross-section.

Referring now more particularly to FIGS. 1, 4 and 5, the cylinder release and safety lever of the present invention consists in this instance of a generally cylindrical shaft 66, which extends transversely through the frame of the revolver and has a finger-lever 68 at one end adjacent the outer side of the wall 48. A cylindrical end portion 70 of shaft 66 projects a short distance outward of a cover-plate 72 on the opposite side, so that shaft 66 can be shifted lengthwise by pressing in on its end 70. Shaft 66 is pivotally supported at one end in the side wall 48 and at the other end in an opening 74 in cover-plate 72, so that it is in vertical alignment with a tail-piece 76 on the cylinder hand 22, as shown in FIGS. 2 and 3, and in generally horizontal alignment with the spindle 32 of cylinder 14 (FIGS. 6 and 7).

A clearance cut 78 (FIGS. 2–4) is formed in shaft 66 at a point along its length which coincides with cylinder hand 22, so that when the shaft 66 is disposed in its normal position as illustrated in FIG. 2 by the phantom-line showing of finger-lever 68, the tail-piece 76 on hand 22 can pass freely into the clearance cut 78 when the trigger 20 is retracted. However, on pivoting shaft 66 clockwise as viewed in FIGS. 1–3 to the position illustrated in FIG. 3 by the phantom-line showing of finger-lever 68, the clearance-cut 78 is moved out of alignment with the tail-piece 76, so that cylinder hand 22 is blocked positively preventing actuation of the trigger. Accordingly, when the lever 68 is moved down the revolver is positively prevented from being fired, whether in double-action or in single-action, because in either mode of firing the cylinder hand 22 is raised simultaneously with the retraction of the hammer to its cocked position. Consequently, when the cylinder hand is blocked, the trigger cannot be retracted and this in turn prevents cocking of the hammer due to its interengagement with the trigger, not only by the gear segments 49 and 50, but also by the sear nose 51 and cocking foot 52.

Since inadvertent movement of the lever 68 to its safe position is undesirable, and under some circumstances could be fatal to a person who finds himself in a situation where he must be able to fire with little or no warning, provision is made for preventing the lever from being moved accidentally from the position shown in FIG. 2 to the position of FIG. 3. To this end, the outwardly projecting portion of pin 47 (FIG. 4), extends into a stepped recess 80 in the under surface of the finger-lever 68. Recess 80 is formed with a deep portion 82 at one end and a shallow portion 84 at the other. When shaft 66 and its finger-lever 68 are disposed in the position shown in FIGS. 1 and 2, pin 47 is located in the deep portion 82 of the recess in engagement with a step 85 between the two sections of recess 80. It is therefore not possible to turn the lever 68 to the safe position shown in FIG. 3 without first moving the lever lengthwise of pin 47 so that the step 85 clears the end of the pin.

While such action can be achieved in various ways, as for example by mounting the lever 68 resiliently on shaft 66 so that it can be lifted over the end of pin 47, it is preferred in this instance to make the lever integral with the shaft and to shift the shaft 66 lengthwise, so that lever 68 is moved outward to the broken-like position shown in FIG. 4. Lever 68 can then be turned clockwise from its full-line position shown in FIG. 1 to its safe position shown in FIG. 3. An elongate flat spring 86 (FIGS. 4, 8 and 9) is rigidly mounted at one end on frame 12 by means of a screw 88, the other end being bifurcated to fit within a circumferential slot 90 adjacent the end 70 of shaft 66. Spring 86 is biased outwardly (to the left as shown in FIG. 4) against the outer wall 92 forming slot 90, thereby resiliently urging shaft 66 lengthwise while by the same token urging lever 68 to its full-line position.

In order to turn lever 68 to its safe position, shaft 66 must first be shifted lengthwise against the pressure of spring 86 by pressing inward (to the right as viewed in FIG. 4) against its exposed end 70. By then rotating lever 68 downward from its full-line position shown in FIG. 1, the shallow portion 84 of recess 80 is moved across the end of pin 47 until the end of pin 47 engages within a detent 93 in the lever 68, thereby resiliently holding the lever in its safe position under the pressure of spring 86. To remove the safety, lever 68 can simply be rotated back to its normal position without applying pressure against the end 70 of shaft 66. During this movement pin 47 drops back into the deep portion 82 of recess 80 as the shaft 66 and lever 68 return to their full-line positions.

Spring 86 is suitably bent as shown in FIG. 9 so that it can span the distance between the point at which it is secured to the frame 12 and shaft 66 without contacting hammer 18. It is also desirable to provide sufficient space between the engagement surface 94 on the inner side of lever 68 and the outer side 92 of slot 90, so that spring 86 engages the cover-plate 72 just before engagement surface 94 comes in contact with the outer surface of the side wall 48 of frame 12. In this way the spring 86 does not drag against the shaft 66 when it is pivoted upward (counterclockwise) from its normal, full-line position shown in FIG. 1 for the purpose of releasing cylinder 14 in the manner to be described hereinafter.

It will be noted that the deep portion 82 of recess 80 is long enough to allow lever 68 to be pivoted upward from its normal position when it is desired to release the cylinder. Shaft 66 is also provided with a cam-cut 96 (FIGS. 4, 6 and 7), the bottom 98 of which is engaged by a plunger 100 projecting rearwardly from the passage 34 in which the rear end of cylinder spindle 32 is retained. As will be seen in FIGS. 6 and 7, the rear end of plunger 100 and the bottom 98 of cam-cut 96 are arranged so that they engage each other near the periphery of shaft 68 in order to provide as much mechanical advantage as possible when finger-lever 68 is turned counterclockwise from its normal position shown in phantom lines in FIG. 6 to its position shown in FIG. 7. Such camming action drives plunger 100 forward against the pressure of spindle spring 40 until the end of spindle 32 is free of passage 34, allowing cylinder 14 to be swung out on its crane 36 for loading and cleaning purposes.

Plunger 100 is retained in passage 34 by a retaining pin 102, which fits through an elongate notch in the underside of the plunger. It will be noted, however, that plunger 100 should be allowed to move far enough back against the cam surface 98 on shaft 66 in order to urge shaft 66 in a clockwise direction until the step 85 within recess 80 engages stop pin 47. Consequently, cylinder plunger 32 acts as a return spring for finger-lever 68 when it is manipulated to release the cylinder and at the same time holds it firmly against the stop pin 47 when the cylinder 14 is in place and the safety is off.

It will also be noted that cam-cut 96 is made wide enough lenthwise of shaft 66 to permit the shaft to be shifted in a longitudinal direction in order to lift the finger-lever 68 over the stop pin 47, so that it can be turned to its safe position.

What is claimed is:

1. In a revolver having a frame with a cartridge cylinder supported both for rotation thereon and for lateral movement relative thereto into and out of an operative position, and having an action member movable through a predetermined path when the revolver is functioned to fire a cartridge, said cylinder being mounted for rotation on a spindle, one end of which is receivable in a centrally disposed passage in said frame when the cylinder is in its operative position and retractable lengthwise out of such passage in order to release the cylinder so that it can be swung laterally out of the frame, and spring means urging said spindle into said passage, a combined cylinder-release and safety device therefor comprising in combination, a cam shaft pivotally mounted on said frame having a cam portion in position to transmit axial motion to said spindle when said cam shaft is pivoted in one direction against the pressure of said spring means, a stop for limiting the pivotal movement of said cam shaft in the opposite direction at a normal position, means for circumventing said stop in order to permit pivotal movement of said cam-shaft in said opposite direction beyond said stop, said cam shaft having a second portion movable into the path of said action member when said cam shaft is pivoted in said opposite direction beyond said stop, for positively preventing firing of said revolver, and a finger-lever for manually pivoting said cam shaft.

2. A combined cylinder-release and safety device for a revolver as defined in claim 1, wherein said stop comprises a stop pin mounted on said frame in the path of said finger-lever, and which further includes means for lifting said finger-lever over the end of said stop pin in order to permit said shaft to be pivoted in said opposite direction.

3. The combination defined in claim 2, wherein said cam shaft and finger-lever are integral and said shaft is mounted for lengthwise, as well as pivotal, movement to allow said finger-lever to be lifted over said stop pin.

4. The combination defined in claim 3, which includes spring-means for urging said cam shaft lengthwise so that said finger-lever is urged thereby toward said stop pin in such lengthwise direction.

5. A combined cylinder-release and safety device for a revolver as defined in claim 1, wherein said cam portion of said cam shaft comprises a transverse cut in the cylindrical surface of said shaft and having a flat bottom surface, said cam shaft being generally in alignment with said centrally disposed passage with said transverse cut positioned adjacent one end of said passage, a push rod supported in said passage and projecting from said one end thereof for engagement with said bottom surface of said cut, said push rod being engageable at its other end with said cylinder spindle such that upon pivotal movement of said cam shaft in said one direction, said push rod is cammed by said bottom surface against said spindle.

6. The combination defined in claim 5, wherein said action member comprises a cylinder hand for indexing said cylinder, said second portion of said cam shaft comprising a clearance cut formed transversely in the cylindrical surface of said cam shaft adjacent said cylinder hand and arranged relative to said first cut such that when said cam shaft is in its said normal position, said cylinder hand can pass into said clearance cut in order to index said cylinder and when said cam shaft is pivoted in said opposite direction beyond said stop, said cylinder hand is blocked by the cylindrical surface of said cam shaft.

* * * * *